US010323841B2

(12) United States Patent
Kim

(10) Patent No.: US 10,323,841 B2
(45) Date of Patent: Jun. 18, 2019

(54) LIGHTING DEVICE FOR INDOOR PARKING LOT

(71) Applicant: KMW INC., Hwaseong, Gyeonggi-Do (KR)

(72) Inventor: Duk Yong Kim, Gyeonggi-Do (KR)

(73) Assignee: Gigatera Inc., Hwaseong-si (KR)

( * ) Notice: Subject to any disclaimer, the term of this patent is extended or adjusted under 35 U.S.C. 154(b) by 0 days.

(21) Appl. No.: 14/512,047

(22) Filed: Oct. 10, 2014

(65) Prior Publication Data

US 2015/0029704 A1 Jan. 29, 2015

Related U.S. Application Data

(63) Continuation of application No. PCT/KR2013/002974, filed on Apr. 9, 2013.

(30) Foreign Application Priority Data

Apr. 10, 2012 (KR) ..... 20-2012-0002930 U

(51) Int. Cl.
*F21V 33/00* (2006.01)
*F21S 8/04* (2006.01)
(Continued)

(52) U.S. Cl.
CPC ..... *F21V 33/006* (2013.01); *F21S 2/00* (2013.01); *F21S 8/04* (2013.01); *F21S 8/043* (2013.01);
(Continued)

(58) Field of Classification Search
CPC ..... F21K 9/1355; F21V 33/006; F21S 8/04; F21S 8/043; F21S 8/046
(Continued)

(56) References Cited

U.S. PATENT DOCUMENTS

2004/0042203 A1* 3/2004 Ladstatter ..... F21V 7/0016 362/147
2009/0185376 A1 7/2009 Yu
(Continued)

FOREIGN PATENT DOCUMENTS

CN 85204467 U 8/1986
CN 202125763 U 1/2012
(Continued)

OTHER PUBLICATIONS

CN Office Action dated Dec. 5, 2016 in corresponding CN Patent Application No. 201380019251.8.
(Continued)

*Primary Examiner* — Gerald J Sufleta, II
(74) *Attorney, Agent, or Firm* — Mintz Levin Cohn Ferris Glovsky and Popeo, P.C.; Kongsik Kim; Jhongwoo Jay Peck

(57) ABSTRACT

The present invention relates to an indoor parking lot, comprising: a hollow frame portion, which is installed in the lengthwise direction on the ceiling along a driving path; and a lighting portion, which is fixedly installed on a side surface of the frame portion, for lighting the driving path and parking space around the driving path, wherein the lighting portion provides light distribution which is perpendicular to a driving direction of the driving path. The present invention is installed along the driving path of a vehicle which is between the parking spaces, so as to limit light distribution to directions on both sides of the direction of installation, thereby reducing the number of lighting portions while providing light having ample brightness to the parking spaces and a lighting space and thus effectively minimizing power consumption despite constant lighting.

2 Claims, 7 Drawing Sheets

(51) Int. Cl.

| | |
|---|---|
| ***F21S 2/00*** | (2016.01) |
| *F21W 131/103* | (2006.01) |
| *F21W 131/101* | (2006.01) |
| *F21W 131/40* | (2006.01) |
| *F21V 21/005* | (2006.01) |
| *F21Y 115/10* | (2016.01) |

(52) U.S. Cl.
CPC ..... *F21S 8/046* (2013.01); *F21V 21/005* (2013.01); *F21W 2131/101* (2013.01); *F21W 2131/103* (2013.01); *F21W 2131/40* (2013.01); *F21Y 2115/10* (2016.08)

(58) Field of Classification Search
USPC ..... 362/147–148, 150
See application file for complete search history.

(56) References Cited

U.S. PATENT DOCUMENTS

2009/0279298 A1* 11/2009 Mier-Langner ..... F21V 21/096 362/235
2011/0001626 A1* 1/2011 Yip ..... H05B 37/0263 340/635
2011/0156584 A1* 6/2011 Kim ..... F21K 9/00 315/32
2012/0001554 A1* 1/2012 Leadford ..... F21S 2/005 315/158
2012/0039067 A1 2/2012 Kim et al.
2013/0063963 A1* 3/2013 Riesebosch ..... F21V 21/34 362/555

FOREIGN PATENT DOCUMENTS

| | | | | |
|---|---|---|---|---|
| DE | 20 2007 017735 | U1 | | 2/2008 |
| JP | 06283010 | A | * | 10/1994 |
| JP | 08-298012 | A | | 11/1996 |
| JP | 3127899 | U | | 12/2006 |
| JP | 2009049405 | A | | 3/2009 |
| JP | 2009-123494 | A | | 6/2009 |
| JP | 2010-526422 | A | | 7/2010 |
| JP | 2011-028981 | A | | 2/2011 |
| JP | 2011-258476 | A | | 12/2011 |
| JP | 2012-064392 | A | | 3/2012 |
| JP | 2012064399 | A | | 3/2012 |
| JP | 2012-066610 | A | | 4/2012 |
| KR | 20-2008-0000299 | U | | 3/2008 |
| KR | 2008-0113722 | A | | 12/2008 |
| KR | 10-2010-0086709 | A | | 8/2010 |
| KR | 20-2010-0012997 | U | | 12/2010 |

OTHER PUBLICATIONS

JP Office Action dated Aug. 29, 2016 in corresponding Japanese Patent Application No. 2015-505638.

* cited by examiner

LIGHTING DEVICE FOR INDOOR PARKING LOT

CROSS-REFERENCE TO RELATED APPLICATIONS

This application is a continuation of International Application No. PCT/KR2013/002974 filed on Apr. 9, 2013, which claims priority to Korean Application No. 20-2012-0002930 filed on Apr. 10, 2012. The applications are incorporated herein by reference

TECHNICAL FIELD

The present invention relates to a lighting device for an indoor parking lot, and more particularly to a lighting device for an indoor parking lot which can prevent glare during parking of a vehicle and intensively light a parking space.

BACKGROUND ART

In general, a plurality of fluorescent lights are installed on a ceiling of an indoor parking lot. Fluorescent lights as light sources are relatively inexpensive but have a relatively short life span, and the brightness of the fluorescent lights decreases over time.

A radiation angle corresponding to an angle by which light is emitted is 120 degrees or more, and a parking lot is illuminated at intensities of illumination which are similar as a whole.

In order to solve a problem of a fluorescent light as a light source, which has a relatively short life span and a brightness of which gradually decreases over time, technologies for employing LEDs having a relatively long life span and consuming low electric power as lighting units of an indoor parking lot have been developed.

Korean Patent Application Publication No. 10-2010-0086709 discloses such an example. Korean Patent Application Publication No. 10-2010-0086709 discloses a lighting control device for a basement parking lot, for lighting an indoor parking lot using LEDs which are partially switched on according to a motion of a person.

However, although the device is designed to save electrical energy by simply replacing fluorescent lamps according to the related art by LED units, and selectively switching on and off the LED units according to a motion of a vehicle, it is further difficult to prevent crime and maintain security because there is no lighting unit around a hidden person who minimizes a motion.

Further, sensors for detecting a motion of a vehicle or a person should be installed at important points, and because a switching system for coping with detection results of the sensors should be equipped, installation costs increase and maintenance costs also increase.

In addition, in a lighting device of an indoor parking lot including a basement parking lot and an above-ground parking lot according to the related art, lighting units should be installed one the upper sides of a track of a vehicle and a parking space, energy consumption is relatively high.

SUMMARY

Therefore, the present invention has been made in view of the above-mentioned problems, and an aspect of the present invention is a lighting device for an indoor parking lot which can minimize power consumption while normally providing lighting.

The present invention also provides a lighting device for an indoor parking lot which can prevent a safety accident by preventing glare.

The present invention also provides a lighting device for an indoor parking lot which can be easily maintained and repaired.

The present invention also provides a lighting device for an indoor parking lot which can be easily and promptly installed by installing a monitoring camera in an indoor parking lot at the same time.

In accordance with an aspect of the present invention, there is provided a lighting device for an indoor parking lot, including: a hollow frame installed on a ceiling lengthily along a track; and a lighting unit fixedly installed on a side surface of the frame, for lighting the track and a periphery of the track and providing a light distribution perpendicular to a travel direction of the track.

The lighting device for an indoor parking lot according to the present invention is installed along a vehicle track between parking spaces to limit a light distribution on opposite sides of the installation direction to provide a parking space and a lighting space with a sufficient intensity of illumination while reducing the number of lighting units, thereby minimizing power consumption while normally lighting the parking lot.

Further, the lighting device for an indoor parking lot according to the present invention can prevent a driver from being blinded by glare due to the lighting device when a vehicle enters or proceeds to a parking space, thereby preventing loss of attention due to the glare and preventing a safety accident.

In addition, the lighting device for an indoor parking lot according to the present invention can be easily installed at an installation location of a ceiling of a parking lot, can be easily maintained and repaired, and can minimize initial installation costs and maintenance costs.

Moreover, the lighting device for an indoor parking lot according to the present invention can solve an inconvenience of separately installing a lighting device and a monitoring camera because a monitoring camera can be installed at the same time.

DETAILED DESCRIPTION

Hereinafter, a configuration and an operation of a lighting device for an indoor parking lot according to exemplary embodiments of the present invention will be described with reference to the accompanying drawings.

Figure 1:
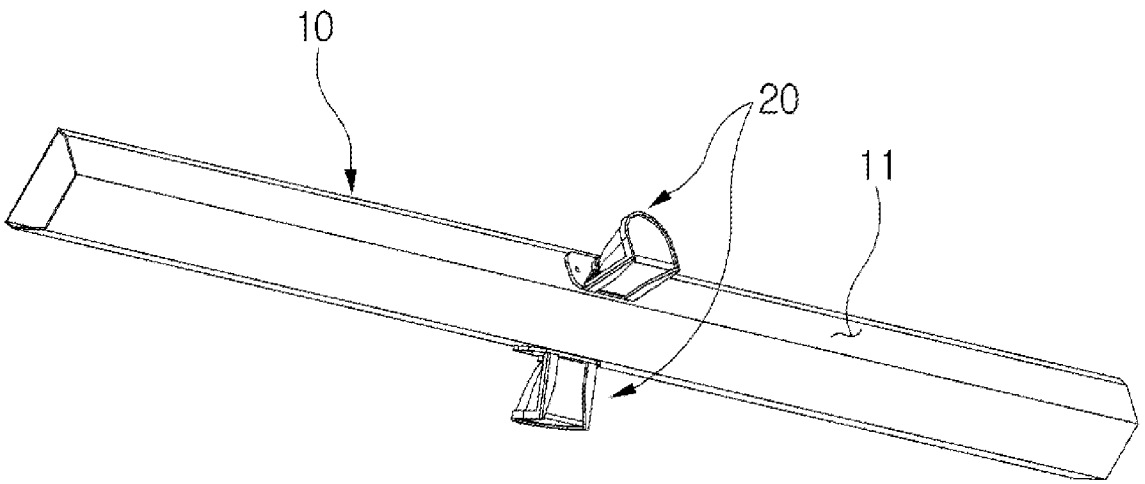
FIG. 1 is a perspective view showing a bottom side of a lighting device for an indoor parking lot according to an embodiment of the present invention.
Figure 2:
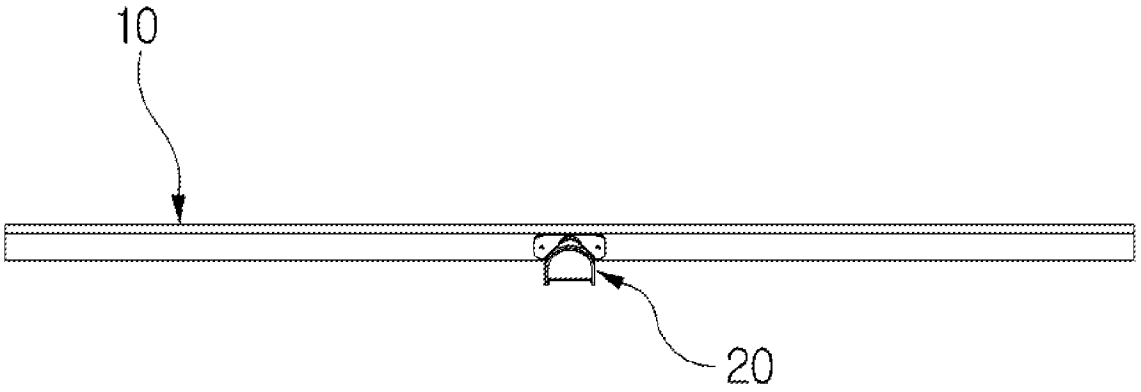
FIG. 2 is a front view showing the lighting device for an indoor parking lot according to the embodiment of the present invention.
Figure 3:
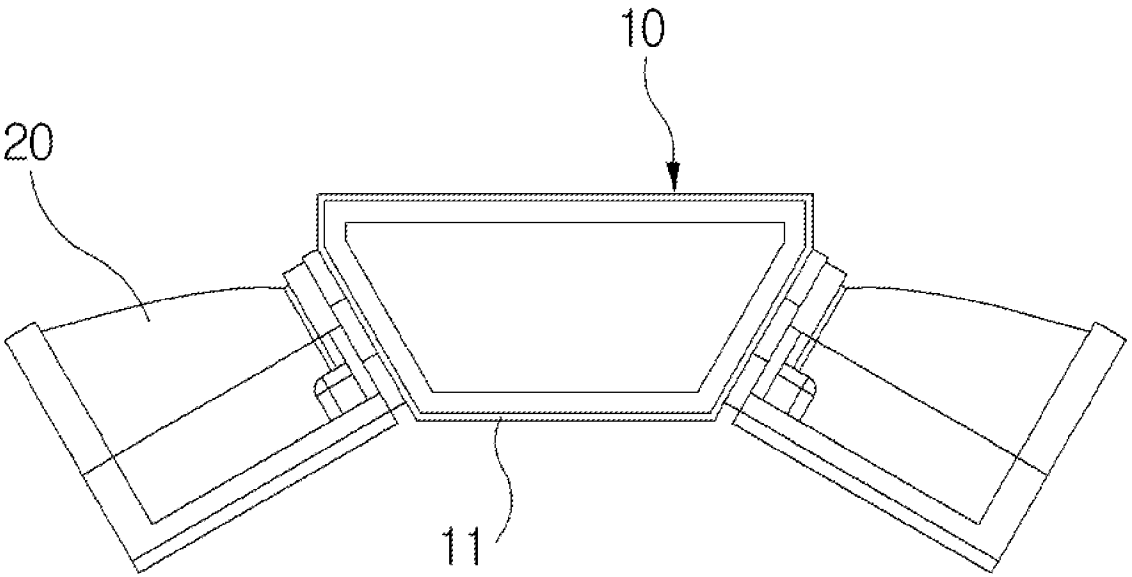
FIG. 3 is a side view showing the lighting device for an indoor parking lot according to the embodiment of the present invention.
Figure 4:
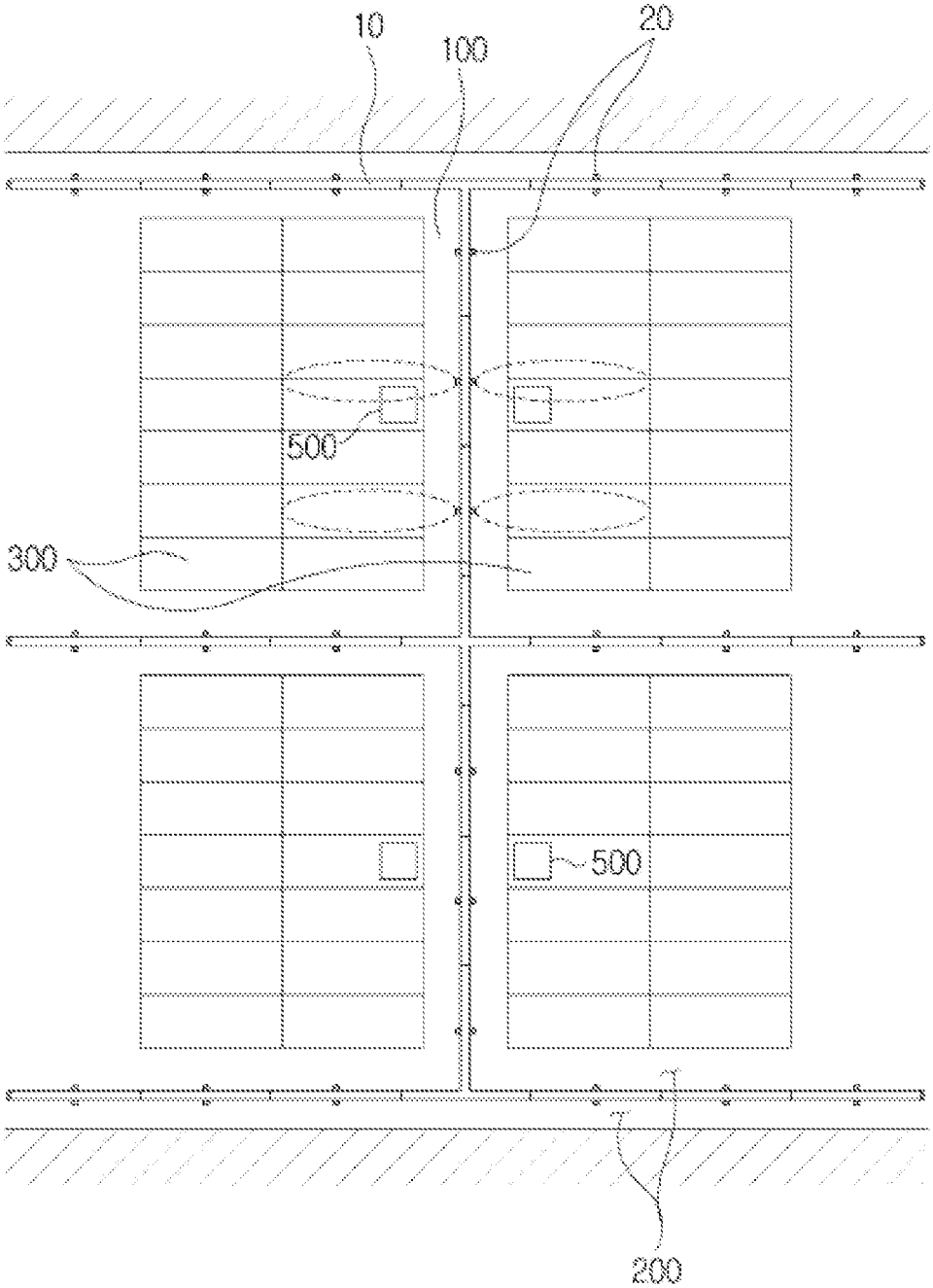
FIG. 4 is a plan view for explaining an installation location of the lighting device for an indoor parking lot according to the embodiment of the present invention.

FIG. 1 is a perspective view showing a bottom side of a lighting device for an indoor parking lot according to an embodiment of the present invention. FIG. 2 is a front view of FIG. 1. FIG. 3 is a side view of FIG. 1. FIG. 4 is a plan view for explaining an installation location of the lighting device for an indoor parking lot according to the embodiment of the present invention.

Referring to FIGS. 1 to 4, the lighting device for an indoor parking lot according to an embodiment of the present invention includes a frame 10 into which an electric wire (not shown) is inserted and installed lengthily along a first track 100 having parking spaces 300 on opposite sides thereof and a second track 200 having a parking space 300 on one side thereof and having a wall surface 400 on an opposite side thereof, the frame 10 having an inclined side surface; first and second tracks 100 and 200 installed on a side surface of the frame 10; and lighting units 20 for lighting the parking spaces 300 adjacent to the first and second tracks 100 and 200.

The frame is formed of a light metal or a synthetic resin to be made light-weight, and a double-sided tape may be attached to an upper surface of the frame 10 such that the frame 10 is directly bonded and fixed to a ceiling of a parking lot or the frame 10 may be fixed to the ceiling of the parking lot by a bolt or the like.

The frame 10 is a hollow integral structure, and a wire (not shown) located lengthily in the frame 10 along a lengthwise direction of the frame 10 and branch wires (not shown) branched from the wire, for supplying electric power to substrates provided in the lighting devices 20 may be provided in the frame 10.

The connection of the wires is configured to supply electric power to the lighting devices 20 provided on side surfaces of the frame 10 through the hollows of the frame 10, and may be variously modified and managed.

The frame 10 may be fixed to a ceiling at a central side of the first track 100 or a separate structure fixed to the ceiling, and may be attached to the ceiling through a double-sided tape or fixed to the ceiling through a fixing member such as a bolt as described above.

It is more preferable that a double-sided tape is used when an ease of installation and maintenance is considered.

When the frame 10 is installed in the second track 200, it may be installed at the center of the second track 200 or at a location which leans on the wall surface 400. As defined above, the second tracks 200 are paths located between the parking lots 300 and the wall surfaces 400 and along which vehicles may move, and the frame 10 may be fixedly installed to be closer to the wall surfaces 400 such that the lighting devices 20 may be installed only on a side of the frame 10 opposite to the wall surface 400.

This structure is designed as occasion demands, and the present invention is not limited by the installation location of the frame 10 close to the second track 200.

A side surface of the frame 10 is an inclined surface 11 such that a width of the bottom surface of the frame 10 facing the bottom surface of the parking lot is narrower than a width of the upper surface of the frame 10 contacting the ceiling, and the lighting unit 20 is fixedly coupled to the inclined surface 11 of the frame 10. As described above, the lighting unit 20 receives electric power through the branch wire branched from the electric wire accommodated within the frame 10.

Figure 5:
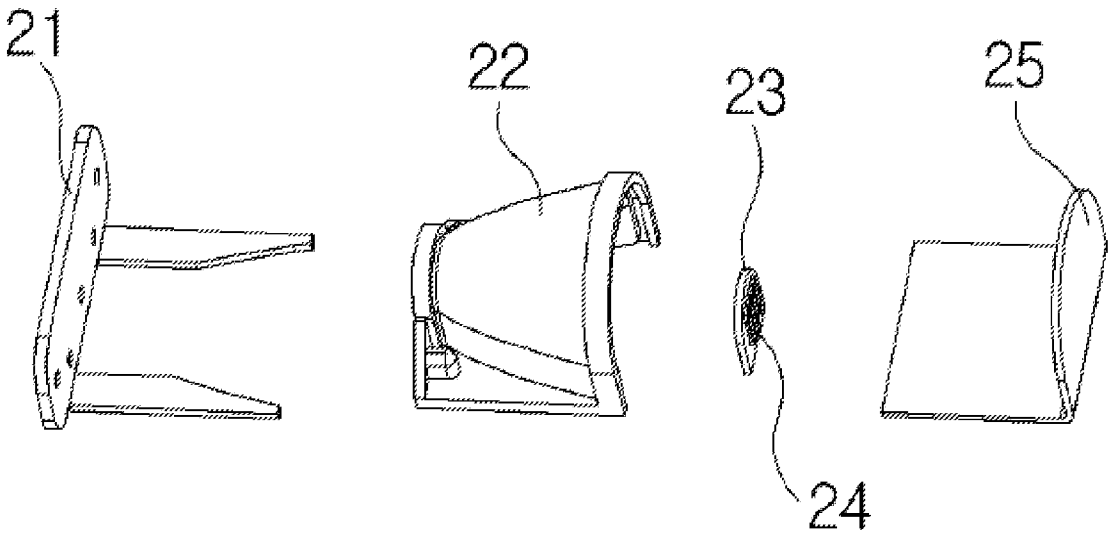
FIG. 5 is an exploded perspective view showing a lighting unit applied to the present invention.

FIG. 5 is an exploded perspective view showing the lighting unit 20 according to the present invention.

Referring to FIG. 5, the lighting unit 20 according to the present invention includes a bracket 21 for coupling to the inclined surface, which is a side surface of the frame 10, a housing 22 fixed to the bracket 21, a substrate 23 fixed to an inside of the housing 22 in parallel to the bracket 21, for receiving electric power through the frame 10, and an LED 24 mounted to the substrate 23, for emitting light.

The housing 22 has a semi-cylindrical structure in which a bottom side and a front side thereof is opened and functions to adjust a light distribution of light emitted from the LED 24, and a cover 25 may be coupled to an opened portion of the housing 22 such that the housing 22 is finished.

The light of the lighting unit 20 is distributed lengthily in a direction perpendicular to a lengthwise direction of the frame 10 by the housing 22 having the opened bottom and front sides, and the light of the LEDs cannot be viewed by the driver of a vehicle which travels along the first track 100 and the second track 200 but light may be irradiated to or reflected in the parking space 300 or on the wall surface 400 or a column 500 of the parking space 300 to provide a brightness of a reference intensity of illumination or more.

In particular, light of a uniform intensity of illumination can light the parking spaces 300 while power consumption is reduced, by using the lighting units 20 spaced apart from each other through adjustment of the light distribution.

Figure 6:
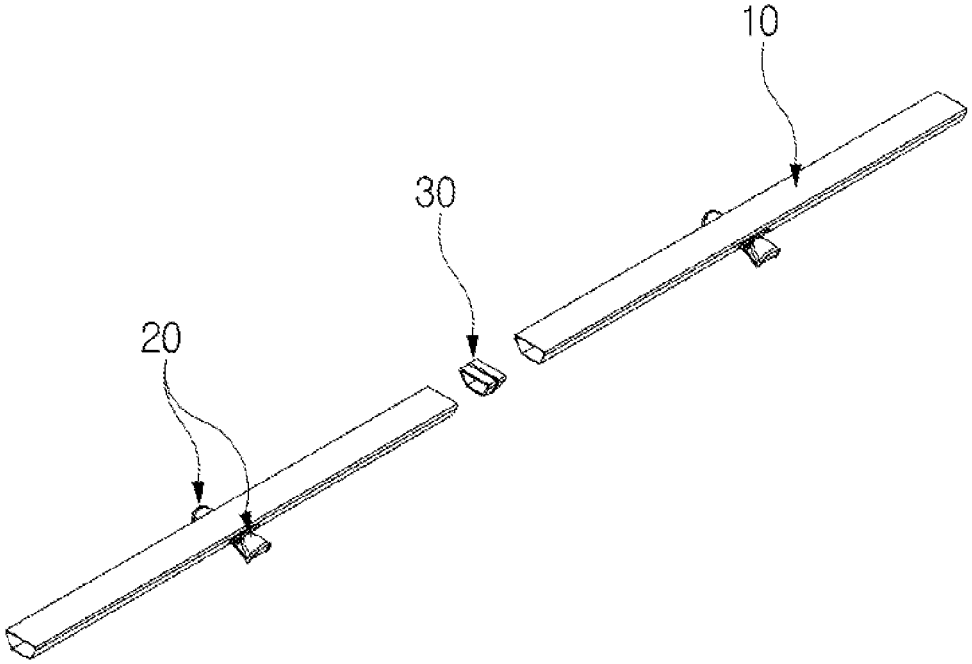
FIGS. 6 and 7 are exploded perspective view showing a lighting device for an indoor parking lot according to another embodiment of the present invention.

FIG. 6 is an exploded perspective view showing a lighting device for an indoor parking lot according to another embodiment of the present invention.

Referring to FIG. 6, the lighting device for an indoor parking lot according to the another embodiment of the present invention is provided to explain that a plurality of frames 10 may be connected to each other when the structures described with reference to FIGS. 1 to 3 are actually installed, and a portion of a connection adapter 30 is inserted in a lengthwise direction of the frame 10 and another side of the connection adapter 30 is inserted into another frame 10 such that the frame 10 can be expanded in the lengthwise direction thereof.

Opposite ends of the connection adapter 30 have the same shape as that of the frames 10 but a size smaller than that of the frames 10 to be inserted into the hollows of the frames 10, and a central portion of the connection adapter 30 has at least the same area as that of inner surfaces of the hollows of the frames 10 so as not to be inserted into the inner surfaces of the hollows of the frames 10. In this case, although the expression of area has been used, it is only for a convenience of description and it will be easily understood by those skilled in that art that the area corresponds to a size of a side surface of a space defined by the upper surface, the inclined surface 11, and the bottom surface of the frame 10.

In this way, because the lighting device according to the present invention may be extended along the first track 100 and the second track 200 as shown in FIG. 4 using the connection adapter 30, it may be applied to a parking lot irrespective of a width and a length of the parking lot.

Figure 7:
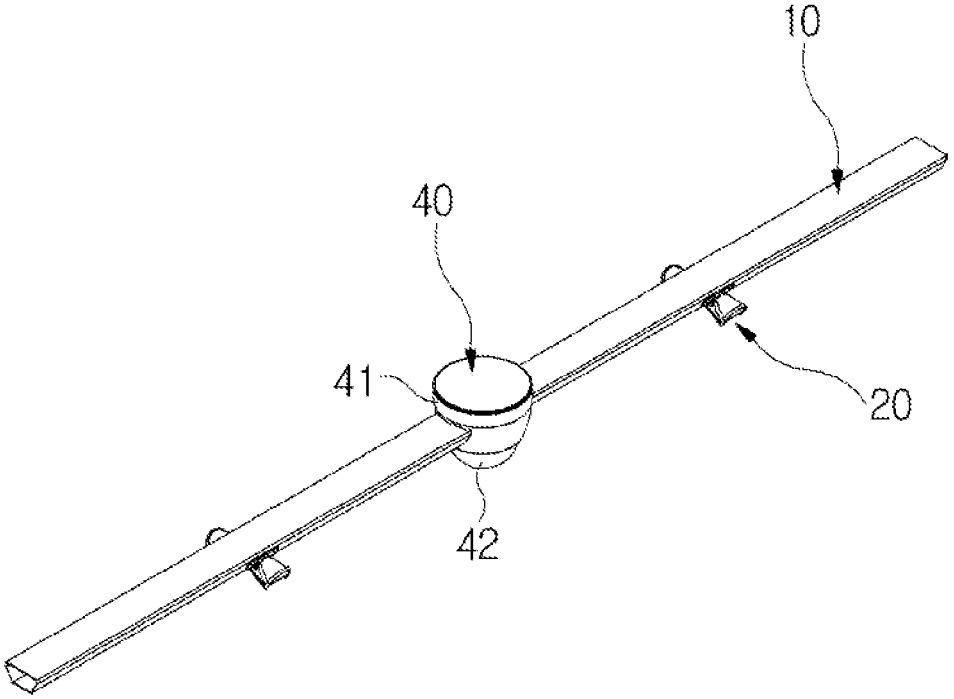

FIG. 7 is a view showing the lighting device for an indoor parking lot according to another embodiment of the present invention.

Referring to FIG. 7, the camera 40 may be attached to the frame 10. Then, the camera 40 is adapted to monitor and record a situation of a parking lot, and monitors generation of a safety accident to identify theft or arson of a vehicle.

The camera 40 includes a camera housing 41 and a camera cover 42 in appearance, and the frame 10 may be connected to the camera housing 41 and the camera 40 may be fixed to a bottom surface of the frame 10 if necessary.

The camera 40 requires a power line for receiving electric power and a signal line for transmitting an image photographed by the camera 40, and both the power line and the signal line are inserted into the frame 10.

The connection of the camera 40 can solve an inconvenience of separately installing a lighting device and a camera, wiring power lines for supplying electric power, respectively, and separately using a mold for wiring a signal line in the camera according to the related art.

According to the present invention, lighting and monitoring devices can be installed at the same time by adding the lighting units 20 which distribute light in a direction perpendicular to a travel direction of a vehicle traveling in the first and second tracks such that the vehicle does not cause glare to the inclined surface 11, which is a side surface of the frame 10, and installing the camera 40 on the bottom surface of the frame 10 in an area between the lighting units 20.

It will be appreciated by those skilled in the art to which the present invention pertains that the present invention is not limited to the embodiment and may be variously modified without departing from the spirit of the present invention.

The present invention is industrially applicable because power consumption can be reduced by allowing effective lighting while reducing the number of lighting units in an indoor parking lot.

The invention claimed is:

1. A lighting device for an indoor parking lot, comprising:

a hollow frame installed on a ceiling lengthily along a track, wherein the hollow frame includes a bottom surface that faces a bottom surface of the parking lot and an upper surface that contacts the ceiling;

a lighting unit fixedly installed on an outer side surface of the hollow frame; and a camera installed on the hollow frame, wherein the hollow frame has an inclined surface with a width of the bottom surface that is narrower than a width of the upper surface of the hollow frame, for lighting the track and a space around the track and providing a light distribution perpendicular to a travel direction of the track, wherein an electric wire for supplying electric power to the camera and a signal line for transmitting an image photographed by the camera are provided within the hollow frame, wherein the lighting unit includes:

a bracket coupled to the outer side surface of the hollow frame;

a housing having a semi-cylindrical structure;

a cover coupled to the housing;

a substrate fixed to an inside of the housing in parallel to the bracket and configured to receive electric power through an electric wire located within the hollow frame; and an LED mounted to the substrate, for emitting light, wherein the housing includes a rear side fixed to the bracket, a bottom side and a front side which are open, and wherein the cover is coupled to the opened portion of the bottom side and the front side of the housing.

2. The lighting device of claim 1, wherein a connection adapter is inserted into the hollow frame in a lengthwise direction of the hollow frame to extend lengthily along the track.

* * * * *